United States Patent [19]

Habiger

[11] 4,249,557

[45] Feb. 10, 1981

[54] LOAD RESOLVER

[75] Inventor: Cyril W. Habiger, Joliet, Ill.

[73] Assignee: Caterpillar Tractor Co., Peoria, Ill.

[21] Appl. No.: 102,197

[22] PCT Filed: Nov. 8, 1979

[86] PCT No.: PCT/US79/00968

§ 371 Date: Nov. 8, 1979

§ 102(e) Date: Nov. 8, 1979

[51] Int. Cl.[3] ..... F15B 11/16; F15C 3/06

[52] U.S. Cl. ..... 137/112; 60/420; 60/452; 251/367

[58] Field of Search ..... 60/420, 422, 451, 452, 60/484; 137/112; 251/367

[56] References Cited

U.S. PATENT DOCUMENTS

| | | | |
|---|---|---|---|
| 2,778,316 | 1/1957 | Haight | 137/112 X |
| 3,407,833 | 10/1968 | Brandenberg | 137/112 X |
| 3,437,065 | 4/1969 | Robbins | 137/112 UX |
| 3,447,556 | 6/1969 | Howeth | 137/112 |
| 3,592,216 | 7/1971 | McMillen | 137/115 |
| 3,881,513 | 5/1975 | Chang | 251/367 X |
| 4,174,614 | 11/1979 | Dezelan | 60/451 X |

*Primary Examiner*—Robert G. Nilson
*Attorney, Agent, or Firm*—Phillips, Moore, Weissenberger, Lempio & Majestic

[57] ABSTRACT

An improved load resolver (41) is provided of the type which receives a pair of generally unequal pressure signals (32, 34), and which resolves the pair of pressure signals (32, 34) by blocking the lesser and transmitting the greater. Each pressure signal (32, 34) is sent to the load resolver (41) by a respective control valve (18, 20) in a hydraulic system (10). Prior load resolver structures have required angled or intersecting holes therein or special porting therearound. The improved load resolver (41) comprises a first member (58) having a first, axially extending hole (64) and a second member (72) having second and third axially extending holes (78, 104). The members (58, 72) are fitted within a bore (48) of a control valve body (19). The improved load resolver may be utilized in a load resolver system (114) having stackable control valve bodies (17, 19, 21) without the need of special porting therebetween.

9 Claims, 3 Drawing Figures

LOAD RESOLVER

DESCRIPTION

1. Technical Field

This invention relates to a load resolver for a fluid system, such as a load resolver used with stacked valves controlling hydraulic motors.

2. Background Art

Hydraulic powered systems frequently include a pump which supplies two or more hydraulic motors or cylinders. During operation of the system the pressure requirement of each hydraulic motor fluctuates. These fluctuations reflect the particular job being powered at that moment by the hydraulic motor, such as lifting, tilting, extending and so forth.

Accordingly, load resolver are usefully incorporated into such hydraulic systems for transmitting the maximum pressure signal which has been resolved thereby from a plurality of generally unequal pressure signals. This ensures that the hydraulic motor with the greatest pressure requirement at any one point of time is adequately supplied. State-of-the-art circuitry for such systems includes control valves normally associated with each hydraulic motor. These control valves supply hydraulic fluid to the hydraulic motors while at the same time deliver a pressure signal representing the load of each hydraulic motor to the load resolvers.

It is desirable that the control valves be stackable for economy of space, minimization of the types of parts stocked, and elimination of potentially rupturable hydraulic lines. Prior art load resolver structures have required angled or intersecting holes therein which have increased the cost of manufacture thereof. Also, special porting or passages around or between stacked control valves has frequently been necessary in order to interrelate and assemble one load resolver with another load resolver which increases the space and number of parts in conjunction with control valves which are stacked.

DISCLOSURE OF INVENTION

The present invention is directed to overcoming one or more of the problems as set forth above.

In one aspect of this invention, an improvement is provided in a load resolver of the type which receives a pair of generally unequal pressure signals in a chamber, the chamber having means for blocking the lesser of the signals. The improvement comprises a body with a bore therein. A first and a second member are fitted within the bore. The first member has a first hole extending axially relative to the bore. The second member has a second hole extending axially relative to the bore. The first and second holes define the chamber therebetween. The second member also has a slot which communicates a first annular groove surface of the second member with the second hole. The improvement further comprises means for transmitting the greater signal from the chamber to exterior the second member.

In another aspect of this invention, an improvement is provided in a load resolver system wherein said body is a plurality of valve bodies in stacked relationship.

The above load resolver improvements provide for relatively inexpensive manufacture, and further provide for ease of assembly thereof.

BRIEF DESCRIPTION OF DRAWINGS

Other aspects of this invention will become apparent from the following description and accompanying drawings wherein.

BEST MODE FOR CARRYING OUT THE INVENTION

Figure 1:
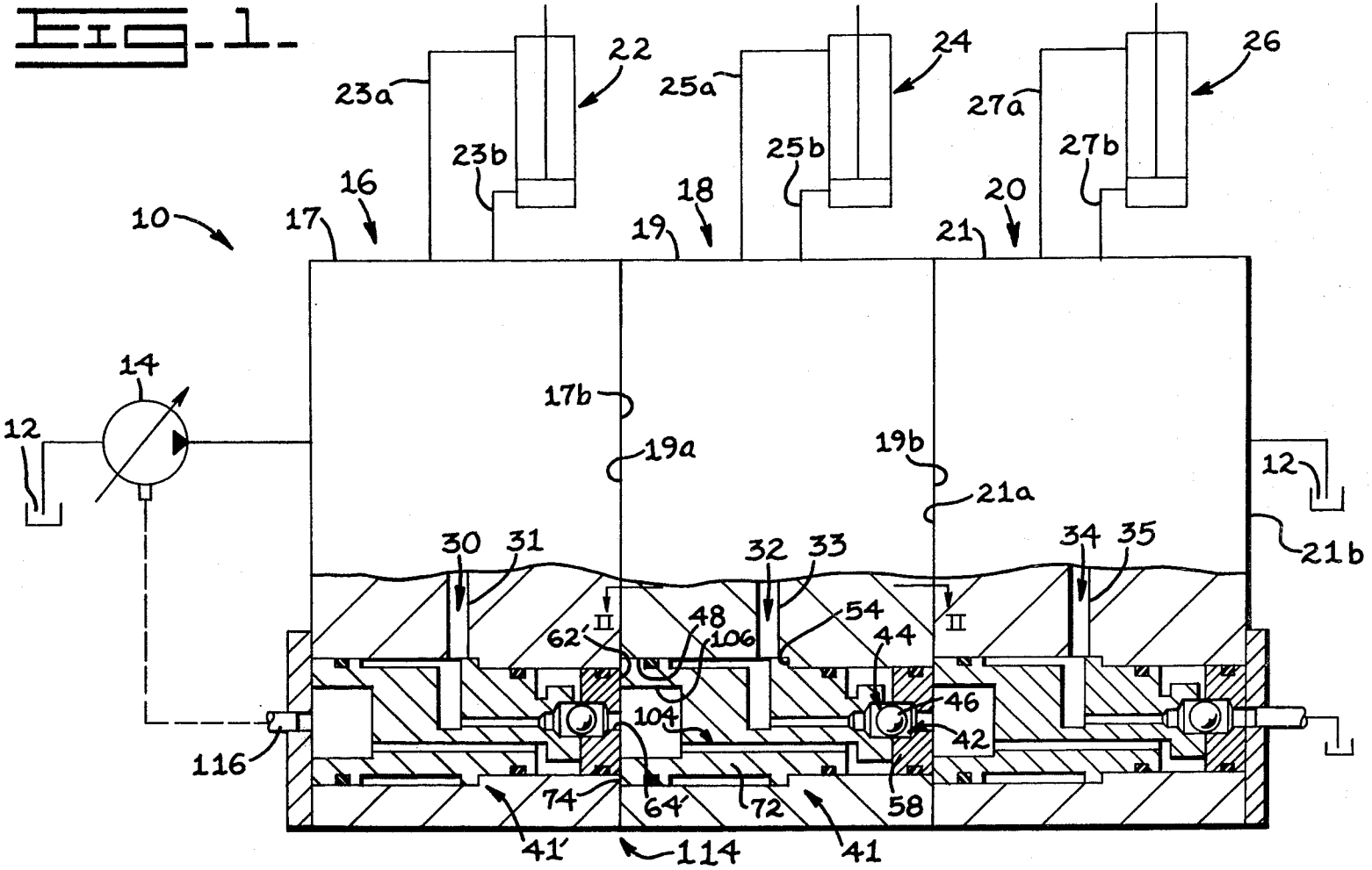
FIG. 1 is a schematic of a hydraulic system which incorporates a partially sectioned view illustrating an improved load resolver embodiment in accordance with the present invention.

Referring to FIG. 1, several components of a fluid system, specifically a hydraulic system 10, are schematically illustrated. Hydraulic system 10 includes a hydraulic fluid supply (sump) 12, a pump 14, control valves 16, 18 and 20, and hydraulic motors or work circuits 22, 24 and 26. The above-described components of hydraulic system 10 are conventional, as is the circuitry therefor. Pump 14 may be a swash plate type pump wherein both fluid flow and pressure vary, and/or the pump 14 may include a relief valve.

Each of the control valves 16, 18 and 20 are associated with a respective one of the hydraulic cylinders 22, 24 and 26. The control valves 16, 18 and 20 are each mounted in a portion of respective valve bodies 17, 19 and 21. Valve bodies 17, 19 and 21 are preferably stackable for economy of space. Such stacking is illustrated by a valve body side **17*b* contacting a valve body side 19*a*, and a valve body side 21*a* contacting a valve body side 19*b*. Control valves 16, 18 and 20 are each substantially the same as the other. Thus, each control valve 16, 18 and 20 includes a pair of conduits 23*a*–23*b*, 25*a*–25*b*, and 27*a*–27*b* connected to opposite ends of the respective hydraulic cylinders 22, 24 and 26. Each control valve 16, 18 and 20 delivers a respective pressure load signal, indicated by arrows 30, 32 and 34, through a respective conduit 31, 33 and 35 passing within the respective valve body 17, 19 and 21. The pressure signals 30, 32 and 34 in conduits 31, 33 and 35 represent the load upon respective work cylinders 22, 24 and 26**, and such pressure signals will be generally unequal and dependent upon the particular work being performed.

Referring to FIG. 1, the present invention provides an improvement in a load resolver, referred to as load resolver embodiment 41, of the type which receives a pair of generally unequal pressure signals, here illustrated as pressure signals 32, 34, in a chamber 42, the chamber 42 having means 44 for blocking the lesser of the signals. The means 44 for blocking may be, for example, a ball 46 disposed within the chamber 42.

The load resolver embodiment 41 includes the valve body 19 with a bore 48 therein. Bore 48 preferably extends through body 19 from the first side portion **19*a* of body 19 to the opposed second side portion 19*b* of body 19. That is, bore 48 is transversely oriented with respect to the sides 19*a*,*b* which will preferably be layered, or stacked, with other control valve bodies. Bore 48 is preferably cylindrical with a stepped portion or shoulder 54 being adjacent the conduit 33. The improved load resolver embodiment 41 includes a two-piece structure. The two-pieces are a substantially cylindrical first member 58 and a substantially cylindrical second member 72**.

Figure 2:
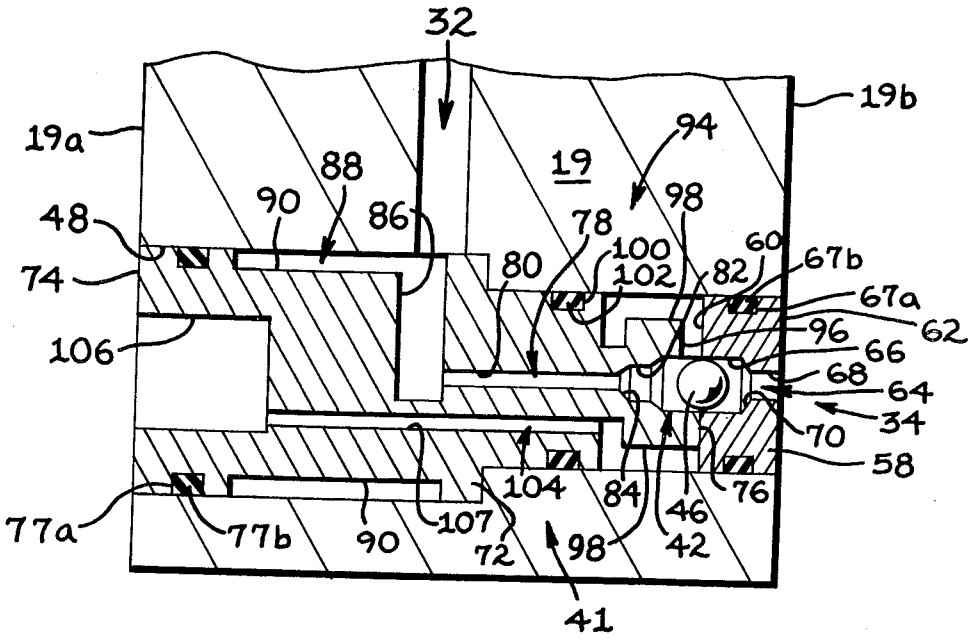
FIG. 2 is an enlarged view of a portion of FIG. 1.

Turning to FIG. 2, the first member 58 has a first end 60 and a second end 62, and is fitted within the bore 48. The fitting is generally a sealing fit. Such sealing fit may be where the first member 58 has a groove 67*a* exteriorly defined thereupon between the ends 60, 62 thereof. An O-ring 67*b* may be disposed in the groove 67*a*.

The first member 58 has a first hole 64 which extends axially relative to the bore 48 to communicate the first hole 64 between the second end 62 of the first member 58 and the first end 60 of the first member 58. The first hole 64 may be easily drilled from the first end 60. The first hole 64 has a first end portion 66 which is of a larger diameter than and contiguous with a second end portion 68. The first and second end portions 66,68 define a seat 70 therebetween. The second end portion 68 of first hole 64 functions to receive the pressure signal 34 therein.

The second member 72 has a first end 74 and a second end 76 and is fitted within the bore 48, generally preferably sealingly fitted such as where the second member 72 has a groove 77*a* exteriorly defined thereupon in which an O-ring 77*b* is disposed.

The second member 72 has a second hole 78 extending axially relative to the bore 48 from the second end 76 thereof. The second hole 78 may be easily drilled from the second end 76. The second hole 78 has a first end portion 80 and a second end portion 82. The second end portion 82 of second hole 78 is of a larger diameter than and contiguous with the first end portion 80. The first and second end portions 80, 82 of second hole 78 form a seat 84 therebetween.

The first and second members 58, 72 are disposed within the bore 48 so as to be closely adjacent, more preferably to be contacting one another with the second end 76 of second member 72 abutting the first end 60 of first member 58. Thus, the first and second holes 64, 78, more particularly the portions 66 and 82, define the chamber 42 therebetween in which the ball 46 may move against either seat 70 or seat 84.

The second member 72 further has a slot 86 which extends radially inwardly from a first annular groove 88 of the second member 72 to the first end portion 80 of second hole 78. The slot 86 may be easily and rapidly formed by cross-cutting in the first annular groove 88 of second member 72. The slot 86 functions to communicate the first annular groove 88 with the second hole 78. The first annular groove 88 is exteriorly defined upon second member 72.

The improved load resolver embodiment 41 further comprises transmitting means 94 for transmitting the greater of pressure signals 32, 34 from the chamber 42 to the first end 74 of the second member 72. The transmitting means 94 may include a notch 96 which extends radially inwardly from a second annular groove 98, defined by one of the first or second members 58, 72, to the chamber 42.

Notch 96 may be formed in said second member 72 adjacent the second end 76 of second member 72, or may be formed in first member 58 adjacent the first end 60 thereof. Such forming may be easily and rapidly accomplished by cross-cutting in annular groove 98 of second member 72. (The notch 96 herein being illustrated as being formed in second member 72, and the second annular groove 98 being exteriorly defined upon the second member 72).

The second annular groove 98 is annularly spaced from the bore 48 and is sealingly disposed from the first annular groove 88, such as where the second member 72 has a groove 100 exteriorly defined thereupon between the first and second annular grooves 88, 98 and an O-ring 102 is disposed therein.

The transmitting means 94 preferably further includes a third hole 104 in the second member 72 axially extending relative the bore 48 and being radially spaced apart from the second hole 78. Accordingly, the third hole 104 is similar to the first and second holes 64, 78 in being easily formed, or drilled. In addition, there is no necessity for having any of the first, second and third holes 64, 78, 104 to be in angled or intersecting relationships one with the others. The third hole 104 extends between the first end 74 of second member 72 and the second annular groove 98. The third hole 104 includes a portion 106 adjacent the first end 74 of second member 72 which is of larger diameter than and axially offset from a remaining portion 107 of third hole 104.

Referring once again to the stacked valve bodies 19 and 21 of FIG. 1, the conduit 33 of valve body 19 functions to communicate the pressure signal 32 into bore 48 and is preferably adjacent shoulder 54. Shoulder 54 aids in locating the first annular groove 88 correctly with respect to conduit 33 when the second member 72 is inserted into bore 48.

Figure 3:
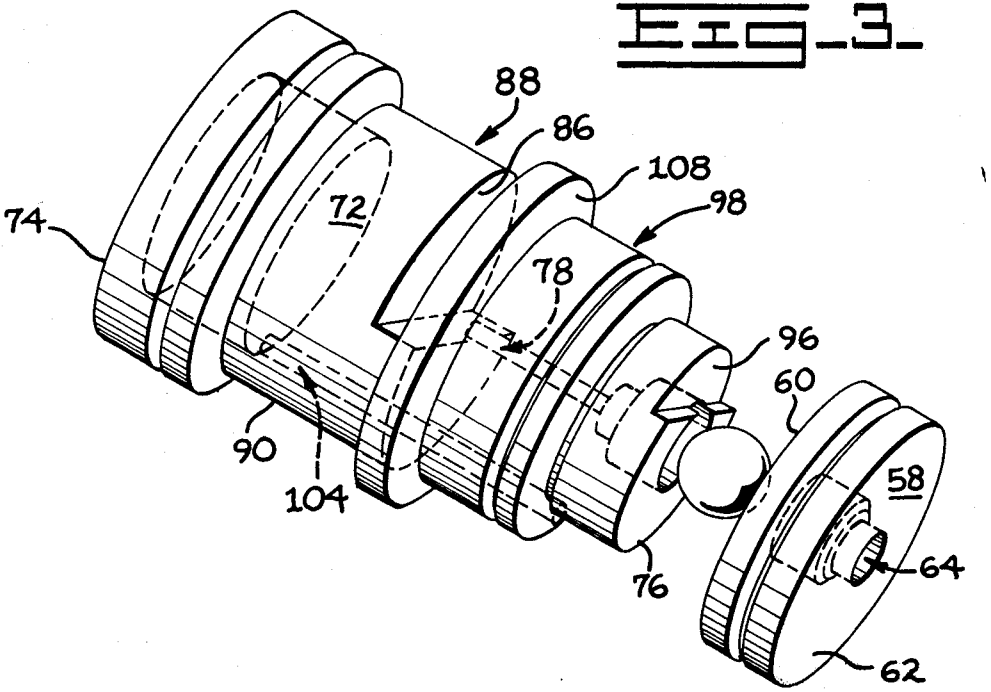
FIG. 3 is an exploded, perspective view of an improved load resolver embodiment detail.

Referring to FIG. 3, the generally cylindrical second member 72 is formed with an annular shoulder 108 exteriorly defined thereupon, the shoulder 108 being adjacent the first annular groove 88 and functioning to position the second member 72 against the shoulder 54 of bore 48.

The conduit 35 of valve body 21 functions to communicate the pressure signal 34 into bore 48 adjacent the side 21*a* of valve body 21, and hence to first hole 64.

Returning to FIG. 1, the present invention provides an improvement in a load resolver system, referred to as a load resolver system embodiment 114. The load resolver system embodiment 114 includes the load resolver embodiment 41 and a load resolver embodiment 41'. The improved load resolver embodiment 41' is illustrated by FIG. 1, wherein numerals identical to those described for the improved load resolver embodiment 41 depict corresponding constructions with the addition of a prime symbol thereafter. The load resolver embodiment 41' is substantially as described for embodiment 41, with embodiment 41 receiving the generally unequal pressure signal pair 32, 34, while the embodiment 41' receives the pressure signal pair which is the higher of pair 32, 34 and pressure signal 30. When the valve bodies 17, 19 and 21 are stacked, embodiment 41 is aligned with embodiment 41' by having the first end 74 of embodiment 41 abutting a second end 62' of embodiment 41'. That is, the embodiments 41 and 41' are in a "head to tail" relationship, and are sandwiched within the valve bodies 17 and 19 for easy interrelation and assembly of the load resolver system embodiment 114 in a minimum of space. The enlarged portion 106 of third hole 104 assists in ensuring proper alignment with and flow into the first hole 64' of embodiment 41'. Thus, there is no need for special porting or passages between stacked valve bodies 17, 19 and 21 of the improved load resolver system 114.

Industrial Applicability

The above-described improved load resolver embodiments find particular application to a system, such as fluid hydraulic system 10 of FIG. 1, wherein it is desired to resolve a plurality of generally unequal fluid pressure signals by blocking the lesser signals while transmitting the highest signal to ensure that an actuator with the highest fluid pressure requirement is adequately supplied.

Referring to FIGS. 2 and 3, it may be seen that the first and second members 58, 72 of the improved load resolver embodiment 41 may be easily and relatively inexpensively manufactured. The first and second annular grooves 88, 98 may be easily made by turning a cylindrical stock member on a lathe, the slot 86 and notch 96 may be rapidly and easily made by cross-cutting on the exterior of such cylindrical stock with a milling machine. The third hole 104 may be axially drilled from the first end 74 of second member 72, the second hole 78 may be axially drilled from the second end 76 thereof, and the first hole 64 may be axially drilled from the first end 60 of first member 58. As the three holes 64, 78 and 104 are all axially extending from ends of the first or second members 58, 72, the drilling thereof may be accomplished by a one step tooling set-up. Further, such a drilling procedure for manufacture of the first and second members 58, 72 does not require angular alignments or angular intersections of drilled holes, which provides for relatively simple and inexpensive manufacture without sacrifice of precision operation thereof.

Turning to FIG. 2, in assembling the improved load resolver embodiment 41, before the valve bodies 19 and 21 are stacked, a one of the first and second members 58, 72 may be inserted into bore 48, the ball 46 placed within either the portion 66 or 82, and then the other member may be fitted within bore 48. Referring to FIG. 1, the load resolver system 114 is assembled by the valve bodies 17 and 19 being stacked, with the side portion 19*a* of body 19 contacting the side portion 17*b* of valve body 17. The bodies 17, 19 are normally held in such stacked relationship by conventional fastening means. As may be understood, the load resolver system 114 could include a greater number of load resolvers than the pair 41, 41' with the three valve bodies 17, 19, 21 herein described, so long as the head to tail relationship previously described is preserved.

It can thus be seen that the improved load resolver 41 of this invention provides a relatively easily and inexpensively manufactured structure, and is particularly useful and easily assembled with stacked control valves of hydraulic systems. Further, the improved load resolver system 114 obviates the need for special porting between stacked control valves in hydraulic systems, hence decreasing the number and type of plugs, seals and the like as well as providing for maximum economy of space.

Other aspects, objectives and advantages of this invention can be obtained from a study of the drawings, the disclosure and the appended claims.

I claim:

1. In a load resolver (41) of the type which receives a pair of generally unequal pressure signals (32, 34) in a chamber (42), said chamber (42) having means (44) for blocking the lesser of said signals (32, 34), an improvement comprising:

a body (19) with a bore (48) therein;

a first member (58) fitted within said bore (48) and having a first hole (64) extending axially relative to said bore (48) and communicating with a second end (62) of said first member (58);

a second member (72) fitted within said bore (48), said second member (72) having a second hole (78) extending axially relative to said bore (48) and communicating with said first hole (64), said first and second holes (64, 78) defining said chamber (42) therebetween, and a slot (86) communicating a first annular groove (88) of said second member (72) with said second hole (78); and, transmitting means (94) for transmitting the greater of said signals (32, 34) from said chamber (42) to an end (74) of said second member (72).

2. An improved load resolver (41) as in claim 1 wherein:

said transmitting means (94) includes a notch (96) extending between said chamber (42) and a second annular groove (98), a one of said first and second members (58, 72) defining said second annular groove (98).

3. The improved load resolver (41) as in claim 2 wherein:

said transmitting means (94) includes a third hole (104) in said second member (72) spaced from said second hole (78) and axially extending relative to said bore (48), said third hole (104) communicating with a first end (74) of said second member (72) and said second annular groove (98).

4. The improved resolver (41) as in claim 3 wherein:

said first member (58) has a first end (60) in contact with a second end (76) of said second member (72).

5. The improved resolver (41) as in claim 3 wherein:

said second annular groove (98) is sealingly disposed (100 and 102) from said first annular groove (88).

6. In a load resolver (41) of the type which receives a pair of generally unequal pressure signals (32, 34) in a chamber (42), said chamber (42) having means (44) for blocking the lesser of said signals (32, 34) an improvement comprising:

a body (19) with a bore (48) therein;

a first member (58) fitted within said bore (48) and having a first hole (64) extending axially relative to said bore (48) and communicating with a second end (62) of said first member (58);

a second member (72) fitted within said bore (48), said second member (72) having a second hole (78) extending axially relative to said bore (48) and communicating with said first hole (64), said first and second holes (64, 78) defining said chamber (42) therebetween, and having a first annular groove (88);

communicating means (86) for communicating said first annular groove (88) with said second hole (78); and, a second annular groove (98) being defined by one of said first and second members (58, 72) one of said first and second members (58, 72) having a notch (96) extending between said chamber (42) and said second annular groove (98).

7. The improved load resolver (41) as in claim 6 further comprising:

said second member (72) having a third hole (104) spaced from said second hole (78) and axially extending relative said bore (48), said third hole (104) communicating with a first end (74) of said second member (72) and said second annular groove (98).

8. In a load resolver system (114) of the type which receives a plurality of generally unequal pressure signals (34, 32, 30) a pair (34, 32) of said pressure signals (34, 32, 30) being received in one (42) of a plurality of chambers (42, 42'), another pair (34, 30 or 32, 30) of said pressure signals (34, 32, 30) being received in the other (42') of said chambers (42, 42'), said chambers (42, 42')

having means (44, 44') for blocking the lesser signal of said paired signals (34, 32; 34, 30 and 32, 30) and for transmitting the greater of said paired signals, an improvement comprising:

a plurality of valve bodies (21, 19, 17) being stackable and having at least a pair of alignable bores (48, 48') defined therein;

a plurality of two-piece members (41, 41'), each member (41, 41') having a first end (74, 74') and a second end (62, 62'), said members (41, 41') being fitted in said bores (48, 48') with a first end (74) of one member (41) being adjacent a second end (62') of another member (41').

9. The improved load resolver system (114) as in claim 8 wherein:

said first end (74) of said one member (41) abuts said second end (62') of said other member (41') when said valve bodies (21, 19, 17) are stacked.

* * * * *